United States Patent [19]

Stagg, Jr.

[11] 4,291,625

[45] Sep. 29, 1981

[54] SHOT GUN SHELL CONSTRUCTION

[76] Inventor: George A. Stagg, Jr., 35 Kime Ave., Wayne, N.J. 07470

[21] Appl. No.: 16,842

[22] Filed: Mar. 2, 1979

[51] Int. Cl.[3] ..... F42B 7/00; F42B 9/16

[52] U.S. Cl. ..... 102/449; 102/532

[58] Field of Search ..... 102/42 R, 42 C, 95; 86/23, 24, 25

[56] References Cited

U.S. PATENT DOCUMENTS

| | | | |
|---|---|---|---|
| 2,125,224 | 7/1938 | Edwards | 102/42 C |
| 2,759,420 | 8/1956 | Schultz | 102/42 C |
| 3,233,546 | 2/1966 | Foote et al. | 102/42 C |
| 3,285,174 | 11/1966 | Maehlman et al. | 102/42 C |
| 3,354,571 | 11/1967 | Parker | 102/43 C |
| 3,516,360 | 6/1970 | Lathrope et al. | 102/95 |
| 3,565,010 | 2/1971 | Sahlmann | 102/42 C |
| 3,575,113 | 4/1971 | Ashbrook et al. | 102/42 C |
| 3,602,143 | 8/1971 | Critcher | 102/42 C |
| 3,662,683 | 5/1972 | Merritt | 102/42 C |
| 3,669,023 | 6/1972 | Maehlman et al. | 102/42 C |
| 3,721,197 | 3/1973 | Hughes et al. | 102/42 C |
| 3,722,420 | 3/1973 | Herter | 102/42 C |
| 3,724,378 | 4/1973 | Knight et al. | 102/42 C |
| 3,750,579 | 8/1973 | Bellington | 102/42 C |
| 3,802,345 | 4/1974 | LaCosta | 102/42 C |
| 3,812,784 | 5/1974 | Herter | 102/42 C |
| 3,974,775 | 8/1976 | Kerzman et al. | 102/42 C |
| 4,004,522 | 1/1977 | Furniss et al. | 102/42 C |
| 4,167,904 | 9/1979 | Ferri | 102/42 C |

FOREIGN PATENT DOCUMENTS

| | | | |
|---|---|---|---|
| 2310361 | 9/1974 | Fed. Rep. of Germany | 102/42 C |
| 1225203 | 6/1960 | France | 102/43 C |
| 5373 | of 1886 | United Kingdom | 102/43 C |

*Primary Examiner*—Harold J. Tudor

*Attorney, Agent, or Firm*—David A. Jackson

[57] ABSTRACT

A shot gun shell is disclosed which employs a wad defining a shot cup, including closure means associated with the open end of the shot cup adapted to operate upon insertion of the wad into the shot gun shell casing to restrain the shot within the cup without the aid of external means. The wad of the present invention employs a one-piece construction and may be manufactured from a plastic material. A shot shell casing is also disclosed which employs a circumferential bead located about the inside surface of the casing adjacent its open end. The bead serves to frictionally retain the wad of the present invention upon its insertion into the casing.

9 Claims, 8 Drawing Figures

SHOT GUN SHELL CONSTRUCTION

BACKGROUND OF THE INVENTION

The present invention relates generally to a shot gun shell construction, and particularly to such construction employing a reusable shell casing and wad.

The prior art contains numerous examples of variations in shot gun shell casing and wad construction. Specifically, the wads well known in the art comprise those prepared in unitary fashion from plastic materials, which provide at one end thereof an obturator skirt for residence against the powder charge, and a shot cup collapsibly connected to the obturator and opening in the opposite direction thereto. The shot cup is frequently provided with an open end and slitted side walls defining petals adapted to flare outward upon ejection of the wad from the gun muzzle, to assist the shot in leaving the shot cup, by offering wind resistance to the movement of the wad.

The foregoing constructions have all required that the loading of the shot shell involve the placement of the powder charge into the shell, followed by the insertion of the wad and the subsequent filling of the wad with shot. Closure of the shell to permit its insertion into the shot gun has conventionally required the inward crimping of the shot shell casing to retain the shot in place within the shot cup and to hold the wad within the casing.

In connection with the above, several constructions have been developed which attempt to provide primary retention of the shot in addition to the outer crimp of the shot shell casing. Specifically, U.S. Pat. Nos. 3,724,378 to Knight et al and 3,575,113 to Ashbrook et al each employ a form of disc-like barrier which is placed within the appropriately receptive open end of the shot cup to abut and retain the shot pellets. Further, U.S. Pat. No. 3,516,360 to Lathrope et al prepares a shot container which comprises a pre-sealed wad structure or shot pouch which defines an opening at its leading end adapted to rupture and release the shot after the shot pouch is ejected from the muzzle of the gun.

All of the aforenoted constructions possess certain drawbacks. Specifically, the shot retainers defined in Ashbrook et al and Knight et al do not obviate the need for the repeated crimping of the outer shell casing upon reloading, and the reloading process remains a time-consuming one. Further, the repeated recrimping of the shot shell casing upon reloading limits the useful life of the casings of the prior art at considerable cost to the user. Accordingly, it has become desirable to reduce the wear on the shot shell casing and to greatly simplify the process of reloading to eliminate the often bothersome task of recrimping the outer shot shell casing.

The present invention is believed to be favorably responsive in the solution of the aforenoted problems.

SUMMARY OF THE INVENTION

In accordance with the present invention a shot gun shell is disclosed which comprises a cylindrical shot cartridge casing having a closed primer end and open end for the reception of a powder charge and a quantity of shot, and a wad adapted to be inserted within the open end of the shot casing to seat therewithin, the wad comprising an obturator structure defining a flared skirt adapted to retain a gun powder charge against the primer end of the casing, and a shot cup flexibly attached in axial alignment with the obturator and oppositely directed to the skirt. The shot cup includes a side wall provided with a plurality of longitudinally extended slots defining a plurality of petals which are attached at their free ends to a pivotal closure structure adapted to retain a quantity of shot pellets within the shot cup when the shot cup is fully thrust home within the shell casing. In a preferred embodiment, the closure structure of the present invention comprises a plurality of wedge-shaped pivotal flaps hingeably attached to the distal ends of the petals of the shot cup, and further includes a locking means provided adjacent the hinged connection of the flaps with the petals, which frictionally engages the inner surface of the shell casing to force the flaps into the closed position.

The invention further includes a shell casing defining a continuous circumferential bead on the inner surface thereof adjacent its open end, which serves to frictionally retain the wad of the present invention therein. The shell casing eliminates the need for crimping the open end after loading and insertion of the wad is completed. The wad of the present invention is merely thrust home after the shot pellets are loaded therein, and the outer edges of the flaps move past the bead to lock the wad within the casing without the need for crimping the open end. In a preferred embodiment of the present invention, the flaps may be provided with radially extending reinforcing ribs which serve to strengthen the flaps and to assist in maintain firm locking engagement of the shot pellets.

Release of the shot pellets is easily accomplished, as, upon the ejection of the wad from the gun muzzle, the flaps spring open and provide, in addition, wind resistance which assists in separating the wad from the shot pellets in flight.

Accordingly, it is a principal object of the present invention to provide a shot gun shell assembly which is easily manufactured and employed.

It is a further object of the present invention to provide a shot gun shell assembly as aforesaid which is inexpensively constructed and provides extended service in use.

It is a yet further object of the present invention to provide a shot gun shell assembly as aforesaid which employs a wad having means defined thereon to independently retain a quantity of shot pellets.

It is a yet further object of the present invention to provide a shot gun shell assembly wherein said assembly may be loaded without the need for crimping the shell casing.

It is a yet further object of the present invention to provide a shot gun shell assembly as aforesaid wherein said shell casing possesses an increased life in use.

Other objects and advantages will become apparent to those skilled in the art from a review of the ensuing description which proceeds with reference to the following accompanying drawings.

DETAILED DESCRIPTION OF THE INVENTION

Figure 1:
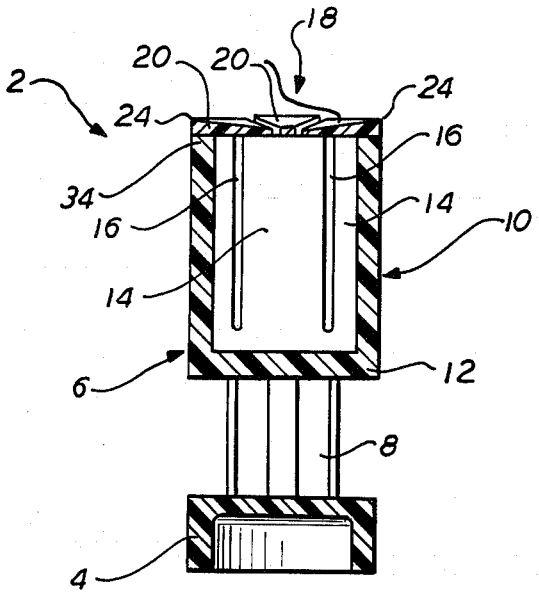
FIG. 1 comprises a side sectional view of the wad of the present invention in the closed position.
Figure 5:
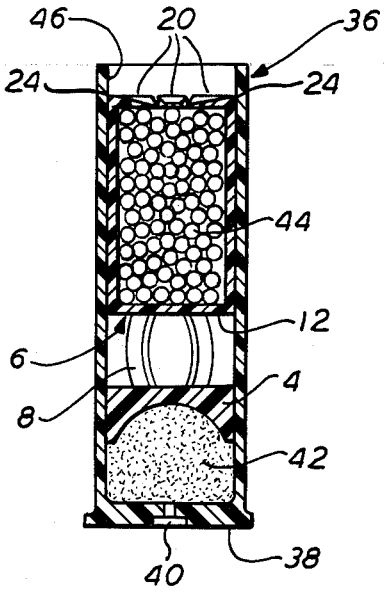
FIG. 5 comprises a side sectional view showing the shot gun shell assembly of the present invention in the fully loaded state.
Figure 6:
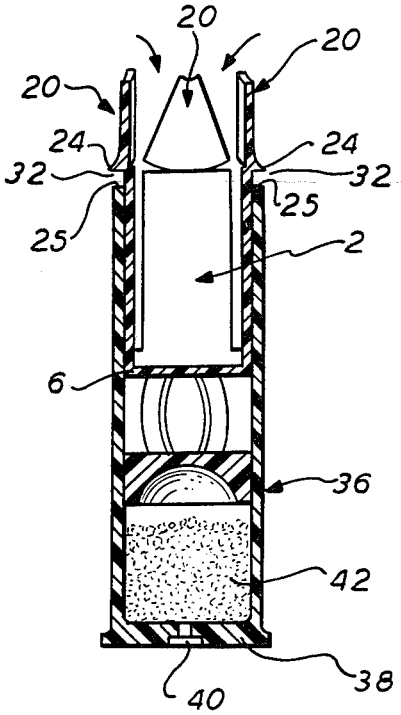
FIG. 6 is a side sectional view illustrating the insertion of the wad of the present invention into a shot shell.

Referring to FIG. 1, the wad of the present invention generally denoted as 2 is illustrated in cross-section as an essentially cylindrical structure having a cup-shaped obturator 4 which serves to overlie and seal the propellant charge placed in the shot shell casing as illustrated in FIGS. 5 and 6. Wad 2 also includes a shot cup 6 situated in coaxial relationship to obturator 4 and connected thereto by a plurality of spaced apart strips 8. Strips 8 may be of a wide variety of configurations, and serve to impart some flexibility and resilience to wad 2 to facilitate tight packing during loading of the shell, as well as to cushion the impact of the ignition of the powder charge when the shell is fired. The specific configuration of the strips 8 is not critical, as a wide variety of well known flexible connection means may be employed between the obturator and the shot cup, and the present invention is not limited to the employment of a particular connection means.

Shot cup 6 includes a generally cylindrical side wall 10 which is integral with a transverse base plate 12 which defines the floor of shot cup 6. Side wall 10 is subdivided into a plurality of petals 14 by a plurality of longitudinally extending slits 16 which extend from the top end of shot cup 6 substantially the entire longitudinal dimension of side wall 10.

In accordance with the present invention, petals 14 define at their free ends a pivotal closure structure 18. Closure structure 18 as illustrated comprises flaps 20 which are adapted to move into the position illustrated in FIG. 1 to close off the shot pellet cavity defined by shot cup 6 to securely retain a quantity of shot pellets. The action of flaps 20 is better illustrated in FIG. 5, wherein a shot gun shell assembly is fully illustrated. Flaps 20 are seen in FIG. 3 to define essentially pie-shaped segments defining on the broad surfaces thereof a generally wedge-shaped configuration provided by leading edges 22, and slightly curved peripheral edges 24 which, as shown in FIG. 2, make tangential contact with adjacent distal transverse edges 25 of petals 14 when flaps 20 are in the open position.

Figure 2:
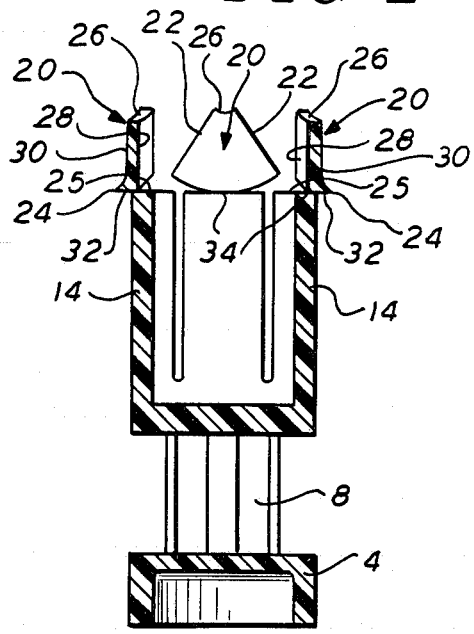
FIG. 2 comprises a side sectional view similar to FIG. 1 showing the wad of the present invention in the open position.
Figure 3:
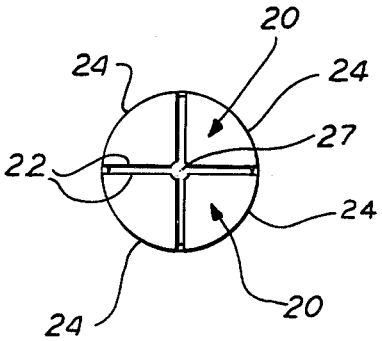
FIG. 3 comprises a top view of the wad of FIG. 1.

Referring further to FIG. 2, flaps 20 can be seen to define in cross-section essentially wedge-shaped structures having concave apical ends 26. In FIG. 3, ends 26 cooperate to define a circular space 27 which provides for dimensional tolerances of the flaps and their movement under load. Flaps 20 also include inner surfaces 28 which are radially displaced with respect to the inner surfaces of petals 14, and similarly displaced outer surfaces 30 which extend radially outward to their termination at peripheral edge 24. Edge 24 is seen in FIGS. 1 and 5 to define a circumference the same as that of side wall 10. In FIG. 2, flaps 20 are open and edges 24 are displaced from the outer walls of petals 14, and define therebetween camming surfaces 32 which serve as the locking means urging and securing flaps 20 in the position shown in FIG. 1 to retain the shot pellets within shot cup 6 when wad 2 is fully inserted within a shot shell casing.

At the point where camming surface 32 mates with the outer surface of petal 14, flap 20 is adapted to pivotally flex in relation to petal 14. This point of flexure comprises hinge 34, best illustrated in FIGS. 2 and 4, as a relatively thin strip-like connection securing flap 20 integrally to the outer circumferential periphery of transverse edge 25 to facilitate the movement of flap 20 in relation to petal 14. Hinge 34 is relatively narrow, as the curvature of edge 24 and camming surface 32 would cause a full width hinge to be too bulky when flaps 20 are in the closed position. Thus, as designed, hinge 34 provides a positive yet unobstructive connection between flaps 20 and petals 14.

Figure 4:
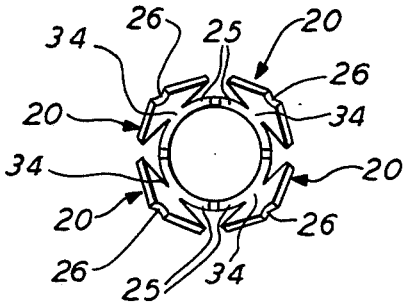
FIG. 4 comprises a top view of the wad of FIG. 2.

The shot cup of the present invention is characterized by preparation from a resilient material which facilitates the pivoting of flaps 20 into the position shown in FIG. 1. Referring to FIG. 2, shot cup 6 may be formed in the position wherein flaps 20 lie in the same plane as petals 14. In a preferred embodiment shown in FIG. 4, flaps 20 may be slightly outwardly biased to facilitate the separation of wad 2 from the shot pellet charge after wad 2 leaves the muzzle of the shot gun. The provision of a shot gun wad with its petals in outward bias is well known in the prior art and does not form a part of the present invention. The natural position of flaps 20 in relation to petals 14 as disclosed in FIG. 4 is important, however, as upon release from the shot shell casing and ejection from the gun muzzle, flaps 20 spring open to release the charge of shot pellets from the shot cup.

The wad of the present invention may be prepared from a variety of materials and is preferably prepared from a plastic material which facilitates the manufacture of the wad in one piece by one of many well known techniques such as injection molding. The wad may be prepared from a wide variety of plastic materials including resins such as ethylene-vinyl acetate copolymers, ethyl acetate copolymers, polyethylene, polypropylenes and the like.

Referring now to FIG. 5, the shot gun shell assembly of the present invention is seen to comprise a shot shell casing 36 defining a closed primer end 38 which holds primer 40 and a quantity of propellant charge 42. Charge 42 is retained in position by obturator 4 which is flexibly connected by strips 8 to shot cup 6 which holds a quantity of shot pellets 44. Shot cup 6 is closed off by the location of flaps 20 in a transverse plane parallel to the plane containing base plate 12. Flaps 20 are locked in this position by the abutment of peripheral edges 24 and camming surfaces 32 with the interior surface 46 of casing 36 adjacent the open end 48 thereof. Edges 24 and camming surfaces 32 act as locks to securely hold flaps 20 in this position to retain pellets 44 and prevent their premature escape from shot cup 6. It can be seen from FIG. 5 that the shot shell assembly of the present invention does not require that casing 36 by crimped or otherwise provided with a closure member to prevent the escape of shot pellets 44. All that is necessary is that the wad of the present invention be appropriately loaded and situated within the shot shell casing.

Referring now to FIG. 6, the wad of the present invention is illustrated as partially inserted within a shot shell casing. Specifically, wad 2 is shown to be inserted subsequent to the placement of a quantity of propellant charge 42 in casing 36 at the position outlined in FIG. 6. The appropriate quantity of shot pellets 44 may then be introduced into the cavity defined by shot cup 6. Upon completing the loading of pellets 44 into shot cup 6, wad 2 may be fully thrust down into casing 36. In this regard, a tamping rod or the like, not shown, may be employed to place pressure against the shot pellet charge to force wad 2 down into casing 36. As wad 2 moves downward, the open edge of casing 36 slidably engages camming surface 32 and forces flaps 20 to pivot inward toward each other, as shown by the arrows in the figure to close off the shot pellet cavity. Once flaps 20 have completed their movement, wad 2 will pass within casing 36 and, as noted earlier, peripheral edges 24 and camming surfaces 32 will secure flaps 20 in the closed position to hold the shot pellets 44 in place.

As shown above, the wad of the present invention greatly simplifies the loading process associated with the repeated use of shot gun shell casings. Further, the design of the wad of the present invention facilitates the rapid separation of the wad from the shot pellet charge to confer a greater uniformity in the shot pellet pattern achieved by the shooter. Specifically, the outward bias of the flaps and their displacement in relation to the petals, as shown in FIG. 2, contributes to the ease of separation from the pellet charge upon ejection, as the flaps 20 have a tendency to spring outward upon ejection from the gun muzzle to offer greater initial wind resistance. The outward bias employed herein is better illustrated in FIG. 4, where flaps 20 appear outwardly biased in relation to petals 14. Such outward bias is distinguishable from that known in the art with respect to the petals, and discussed above, as only the flaps 20 exhibit this bias, and petals 14 retain an unbiased linear configuration.

Figure 7:
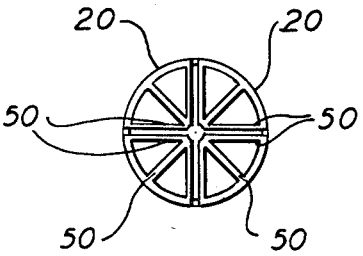
FIG. 7 is a top view similar to FIG. 3 illustrating an alternate embodiment of the invention.

In accordance with a further embodiment of the present invention illustrated in FIG. 7, flaps 20 may be provided with a plurality of ribs 50 situated radially and peripherally along outer surfaces 30. Ribs 50 are provided to impart greater strength and flex resistance to flaps 20 to prevent the premature escape of shot pellets. The employment of reinforcing ribs such as ribs 50 serves to strengthen flaps 20 without the addition of excessive weight or size.

As noted earlier, the wad of the present invention posseses as one of its notable features the provision of a primary closure which holds the shot pellets in place within the shot cup without the need for crimping the shot shell casing. Thus, the wad of the present invention may be employed with a wide variety of shot shell casings, including those of the prior art which conventionally employ crimping in the open end. As the present wad does not rely on such crimping for securement of the shot pellets, it is not necesary that the shell casing be crimped after the wad is fully inserted inside. In fact, the completion of full insertion of the wad may comprise the last step in the loading procedure, and the casing need not be crimped or otherwise deformed. Further, in the instance where previously crimped shell casings are employed, one may sever the crimped portion from the shell casing, thereby retaining the full open end in the manner illustrated in FIGS. 5 and 6, in the confidence that the wad of the present invention will not dislodge once it is fully inserted. Of course, the shot shell casing as useful in accordance with the present invention may, in addition to uncrimped casings, include those casings having some radial constricton at a point at or near the open end thereof, for the further purpose of providing some frictional retention for the present wad after its insertion.

Figure 8:
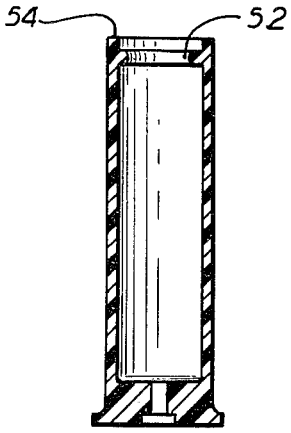
FIG. 8 is a side sectional view illustrating an alternate shell casing in accordance with the present invention.

Referring now to FIG. 8, a shot shell casing is disclosed in an alternate embodiment in accordance with the present invention which provides adjacent its open end 52, an internal bead or rim 54 to retain the wad of the present invention in position within the casing upon full insertion therewith. Thus, a wad 2 could be inserted into the casing of FIG. 8 in the manner and to the extent illustrated in FIG. 6 so that upon loading, and full insertion, the peripheral edge 24 would reside below bead 52, and wad 2 would be precluded from slipping forward and out of the casing. In a preferred embodiment, bead 52 as illustrated in FIG. 8 may extend from about two to about three thousandths of an inch forward from the interior wall 54, and the outer edge 56 of the casing may be beveled a full radius down wall 54 to reduce frictional resistance to the insertion of wad 2 into this casing.

The shot shell assembly of the present invention can be seen to comprise a substantial departure from those casings and wad structures known in the prior art. By the employment of the casing and wad structures of the present invention, shot gun shells may be reloaded without the need of crimping a shell casing prior to use. The casings of the present invention as shown in FIG. 9 may be prepared entirely from a resinuous material such as those outlined with respect to wad 2, thereby reducing the weight and cost of the shell casing. The provision of the relatively rigid casing as shown in FIG. 9 insures that it will withstand repeated reloading and, in combination with the elimination of the need for a crimping step, greatly extends the useful life of the casing component.

It is to be understood that the invention is not limited to the illustrations described and shown herein, which are deemed to be merely illustrative of the best modes of carrying out the invention, and which are suitable of modification of form, size, arrangement of parts and details of operation. The invention rather is intended to encompass all such modifications which are within the spirit and scope as defined by the claims.

What is claimed is:

1. A shot gun shell assembly which comprises:

a shot shell casing having a closed primer and an open shot loading end, and a wad for insertion in said open end comprising a generally cylindrical shot cup defining a side wall and a base plate attached at one end thereof, said side wall longitudinally slotted to define a plurality of curved petals, said petals are connected at the free ends thereof to a pivotal closure structure which is adapted to retain all of the shot pellets within said shot cup when said wad is fully loaded therewith and inserted within said shot shell casing, said closure structure comprising wedge-shaped flaps hingably attached to each of said petals at said free ends, said flaps having a wedge-shaped cross section defined by a first broader portion proximal to said free end, and a second narrower portion distal thereto, said broader portion terminating in a peripheral edge and an adjacent camming surface, said camming surface adapted to cooperate with the inner surface of said shot shell casing to urge said flap into a plane transverse to the axis of said wad, to retain said shot pellets within said shot cup.

2. The assembly of claim 1 wherein said camming surface is located adjacent said hingeable connection.

3. The assembly of claim 1 wherein said flaps correspond in number to said petals, and are located in planes radially outwardly displaced with respect to the planes containing said petals when said closure structure is in the open position.

4. The assembly of claim 1 wherein said flaps define a plurality of reinforcing ribs which extend along the broad outer surfaces thereof.

5. The assembly of claim 1 further comprising a generally annular obturator flexibly attached to said shot cup and opening in the opposite direction thereto for restraining a quantity of shot propellant located within said primer ends.

6. The assembly of claim 1 wherein said shot shell casing defines a circumferential bead located on the inside surface of said casing adjacent said open end, said bead serving to frictionally retain said wad within said casing.

7. A wad for use in a shot gun shell assembly in insertion within a shot shell casing which comprises a generally cylindrical shot cup defining a side wall and a base plate attached at one end thereof, said side wall longitudinally slotted to define a plurality of curved petals, said petals are connected at the free ends thereof to a pivotal closure structure which is adapted to retain all of the shot pellets within said shot cup when said wad is fully loaded therewith and inserted within said shot shell casing, said closure structure comprising wedge-shaped flaps hingably attached to each of said petals at said free ends, said flaps having a wedge-shaped cross section defined by a first broader portion proximal to said free end, and a second narrower portion distal thereto, said broader portion terminating in a peripheral edge and an adjacent camming surface, said camming surface adapted to cooperate with the inner surface of said shot shell casing to urge said flap into a plane transverse to the axis of said wad, to retain said shot pellets within said shot cup.

8. The wad of claim 7 wherein said camming surface is located adjacent said hingeable connection.

9. A shot gun shell assembly which comprises:

a shot shell casing having a closed primer and an open shot loading end, and a wad for insertion in said open end comprising a generally cylindrical shot cup defining a side wall and a base plate attached at one end thereof, said side wall longitudinally slotted to define a plurality of curved petals, said petals are connected at the free ends thereof to a pivotal closure structure adapted to fully retain a quantity of shot pellets within said shot cup when said wad is fully inserted within said shot shell casing, said closure structure comprising a plurality of flaps hingeably attached to each of said petals at said free ends thereof, said flaps cooperating in the closed position to define a substantially complete obstruction to the open end of said shot cup, each of said flaps having a cross sectional width greater than that of the adjacent free end of said petals, and defining a camming surface on the outer surface of said flaps to cooperate with said casing to urge and retain said flaps in the closed position to obstruct the open end of said shot cup.

* * * * *